US005807662A

United States Patent [19]

Takahashi

[11] Patent Number: 5,807,662

[45] Date of Patent: Sep. 15, 1998

[54] SILVER HALIDE PHOTOGRAPHIC LIGHT-SENSITIVE MATERIAL WITH TABULAR SILICATE PARTICLES

[75] Inventor: Shigeaki Takahashi, Hino, Japan

[73] Assignee: Konica Corporation, Japan

[21] Appl. No.: 857,149

[22] Filed: May 15, 1997

[30] Foreign Application Priority Data

May 20, 1996 [JP] Japan ..... 8-124569

[51] Int. Cl.[6] ..... G03C 1/10; G03C 1/34; G03C 1/04; G03C 1/35

[52] U.S. Cl. ..... 430/523; 430/539; 430/600; 430/603; 430/608; 430/611; 430/631; 430/950; 430/965; 430/966

[58] Field of Search ..... 430/603, 600, 430/611, 950, 965, 966, 510, 631, 523, 539, 608

[56] References Cited

U.S. PATENT DOCUMENTS

| | | | |
|---|---|---|---|
| 5,342,750 | 8/1994 | Sasaki et al. | 430/603 |
| 5,478,709 | 12/1995 | Vandenabeele | 430/527 |
| 5,654,134 | 8/1997 | Morimura et al. | 430/603 |

FOREIGN PATENT DOCUMENTS

| | | |
|---|---|---|
| 0617320 | 9/1994 | European Pat. Off. . |
| 0644454 | 3/1995 | European Pat. Off. . |
| 0644455 | 3/1995 | European Pat. Off. . |
| 0768568 | 4/1997 | European Pat. Off. . |
| 4344164 | 5/1995 | Germany . |
| 7/64232 | 3/1995 | Japan . |

OTHER PUBLICATIONS

European Search Report EP 97 30 3403 with Annex.
Patent Abstracts of Japan Pub. # 07064232, dated Mar. 10, 1995.

*Primary Examiner*—Richard L. Schilling
*Attorney, Agent, or Firm*—Jordan B. Bierman; Bierman, Muserlian and Lucas

[57] ABSTRACT

A silver halide photographic light-sensitive material is disclosed. The light-sensitive material comprises comprising a support, having thereon, a silver halide emulsion layer and optionally a hydrophilic colloid layer, in which the silver halide emulsion layer comprises silver halide grains sensitized by a selenium compound or a tellurium compound, and a polysulfide compound, and at least one of the silver halide emulsion layer and the hydrophilic colloid layer contains a tabular particle of a silicate compound.

7 Claims, No Drawings

SILVER HALIDE PHOTOGRAPHIC LIGHT-SENSITIVE MATERIAL WITH TABULAR SILICATE PARTICLES

FIELD OF THE INVENTION

This invention relates to a silver halide photographic light-sensitive material improved in the tone of silver image and inhibited in the pressure fogging and the unevenness of glossiness, and a processing method therefor.

BACKGROUND OF THE INVENTION

Recently, a demand on the rapid processing of silver halide photographic material, particularly a light-sensitive material for medical use, is strongly raised. The rapid processing is strongly demanded because the number of radiophotograph is increased in accordance with increasing in medical examination item for improving the accuracy of diagnosis, and a rapidity of diagnosis is required in the field of emergency medical treatment.

In the rapid processing, it is necessary to raise the transportation speed of film in an automatic processor for shortening the processing time. In such the case, a line-shaped or spot-shaped fogging caused by the pressure of transporting rollers, so-called roller marks, tends to be occurred.

On the other hand, a tabular silver halide grain is well known in the field of the art, which has a increased surface area. By using such the grain, the received amount of light and adsorbed amount of sensitizing dye by individual silver halide grain can be raised for raising the spectral sensitizing efficiency and the covering power. However, the tabular grain having a large diameter/thickness ratio is considerably low in the resistivity against an external pressure and has a drawback that a pressure fogging tends to be occurred which causes the above-mentioned roller marks.

As a means for reducing the pressure fogging, techniques using a latex are disclosed in U.S. Pat. Nos. 2,376,005 and 3,325,386, Japanese Patent Nos. 45-5331 and 46-2506, and Japanese Patent Publication Open for Public Inspection (JP O.P.I.) 51-130217. Further, a technique in which a latex is used together with tabular silver halide grains is disclosed in JP O.P.I. No. 2-135335.

However, the above-mentioned techniques cause formation of an uneven glossiness on the surface of processed film and the visual observation of the image on the film is become difficult even though the pressure fogging can be inhibited in some degree.

In the case of medical X-ray film, an observer visually observe directly a silver image for diagnosis. Consequently, it is strongly demanded for easily reading image that the silver image obtained after processing has no glossiness or no unevenness of glossiness.

Besides, it is required that the light-sensitive material has an excellent developing ability to form a sufficient image density within a shorten time, and it is also important that the light-sensitive material to have high sensitivity.

A chalcogen sensitizing method using a selenium or tellurium compound has been widely known as one of chemical sensitizing methods for silver halide emulsion. However, such the technique raises a serious problem that the tone of the silver image become yellowish and the difficulty of observation of the image is increased similarly to the formation of uneven glossiness, which causes an erroneous diagnosis, even though the sensitivity can be raised in some degree. The degradation in the image tone is particularly large when a tabular silver halide grain is used.

The yellowish tone of silver image is disliked since such the tone gives unpleasant feeling to the observer and a silver image having a pure black tone and no unevenness of glossiness is strongly demanded.

SUMMARY OF THE INVENTION

Accordingly, the object of the invention is to provide a high sensitive silver halide photographic light-sensitive material giving an excellent pure black silver image tone without forming unevenness of glossiness even when the light-sensitive material is subjected to a rapid processing and to provide a processing method for the light-sensitive material.

The above-mentioned object of the invention is attained by a silver halide photographic light-sensitive material comprising a support having thereon a silver halide emulsion layer and optionally a hydrophilic colloid layer, in which the silver halide emulsion layer comprises silver halide grains sensitized by a selenium compound or a tellurium compound, and a polysulfide compound, and at least one of the silver halide emulsion layer and the hydrophilic colloid layer contains a tabular particle of a silicate compound.

DETAILED DESCRIPTION OF THE INVENTION

In the silver halide photographic light-sensitive material of the invention, a selenium compound and/or a tellurium compound and a polysulfide compound are contained in a silver halide emulsion layer thereof. As the polysulfide compound, a compound represented by the following Formula 1 is preferably used.

$$R_1—(S)_n—R_2 \qquad \text{Formula 1}$$

wherein $R_1$ and $R_2$ are each independently an aliphatic group, an aromatic group or a heterocyclic group, the groups represented by $R_1$ and $R_2$ which may be bonded with each other to form a ring, and n is an integer of 2 to 6.

In Formula 1, the aliphatic group represented by $R_1$ and $R_2$ includes an alkyl group, an alkenyl group, an alkynyl group and a cycloalkyl group each having a straight- or branched-chain containing 1 to 30, preferably 1 to 20, carbon atoms. Concrete example of the aliphatic group includes a methyl group, ethyl group, propyl group, butyl group, hexyl group, decyl group, dodecyl group, isopropyl group, t-butyl group, 2-ethylhexyl group, allyl group, 2-butenyl group, 7-octenyl group, propargyl group, 2-butynyl group, cyclopropyl group, cyclopentyl, cyclohexyl group, and cyclododecyl group.

The aromatic group represented by $R_1$ or $R_2$ includes ones having 6 to 20 carbon atoms such as a phenyl group, naphthyl group or anthranyl group.

The heterocyclic group represented by $R_1$ or $R_2$ includes 5- and 6-member rings each having at least one of O, S and N atoms in the ring thereof which may be a single ring or a condensed ring. Concrete example of the heterocyclic group includes a pyrrolidine ring, piperidine ring, tetrahydrofuran ring, tetrahydropyran ring, oxirane ring, morpholine ring, thiomorpholine ring, thiopyran ring, tetrahydrothiophene ring, pyrrole ring, pyridine ring, furan ring, thiophene ring, imidazole ring, pyrazole ring, oxazole ring, thiazole ring, isooxazole ring, isothiazole ring, triazole ring, tetrazole ring, thiadiazole ring, oxadiazole ring, and their benzelogues.

The ring formed by $R_1$ and $R_2$ includes 4- to 7-member rings, preferably 5- to 7-member rings.

The group represented by $R_1$ or $R_2$ is preferably a heterocyclic group, more preferably an aromatic heterocyclic group. The aliphatic groups, aromatic groups and heterocyclic groups represented by $R_1$ or $R_2$ each may further have a substituent. The substituent includes a halogen atom such as a chlorine atom or bromine atom, an alkyl group such as a methyl group, ethyl group, isopropyl group, hydroxyethyl group, methoxymethyl group, trifluoromethyl group or t-butyl group, a cycloalkyl group such as a cyclopentyl group or cyclohexyl group, an aralkyl group such as a benzyl group or 2-phenetyl group, an aryl group such as a phenyl group, naphthyl group, p-tolyl group or p-chlorophenyl group, an alkoxy group such as a methoxy group, ethoxy group, isopropoxy group or n-butoxy group, an aryloxy group such as phenoxy group, a cyano group, an acylamino group such as acetylamino group or propionyl group, an alkylthio group such as a methylthio group, ethylthio group or n-butylthio group, an arylthio group such as a phenylthio group, a sulfonylamino group such as a methanesulfonylamino group or benzenesulfonylamino group, a ureido group such as a 3-methylureido group, 3,3-dimethylureido group or 1,3-dimethylureido group, a sulfamoylamino group such as a dimethylsulfamoylamino group, a carbamoyl group such as a methylcarbamoyl group, ethylcarbamoyl group or dimethylcarbamoyl group, a sulfamoyl group such as an ethylsulfamoyl group or dimethylsulfamoyl group, an alkoxycarbonyl group such as a methoxycarbonyl group or ethoxycarbonyl group, an aryloxycarbonyl group such as a phenoxycarbonyl group, a sulfonyl group such as a methanesulfonyl group, butanesulfonyl group or phenylsulfonyl group, an acyl group such as an acetyl group, propanoyl group or butyloyl group, an amino group such as a methylamino group, ethylamino group or dimethylamino group, a hydroxyl group, a nitro group, a nitroso group, an amine oxide group such as a pyridine oxide group, an imido group such as a phthalimido group, a disulfide group such as a benzene disulfide group or benzothiazolyl-2-disulfide group, and a heterocyclic group such as a pyridyl group, benzimidazolyl group, benzothiazolyl group or benzoxazolyl group.

$R_1$ and $R_2$ each may have one or more substituents among the above-mentioned.

The substituent can be substituted with the above-mentioned substituent. n represents an integer of 2 to 6, preferably 2.

Concrete examples of the compound represented by Formula 1 are listed below.

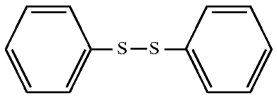
1-1

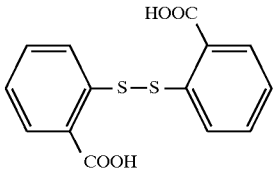
1-2

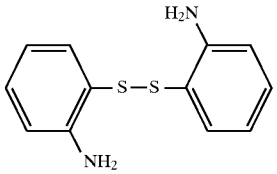
1-3

-continued

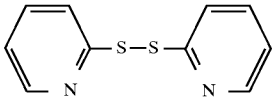
1-4

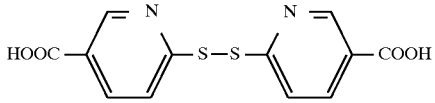
1-5

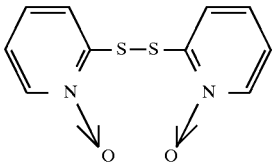
1-6

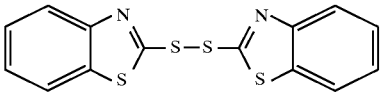
1-7

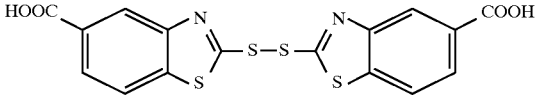
1-8

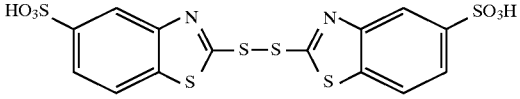
1-9

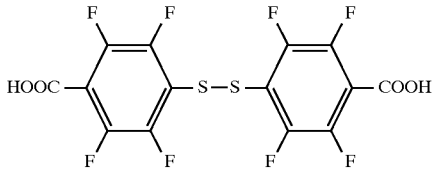
1-10

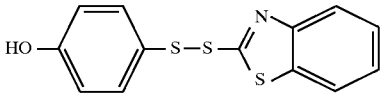
1-11

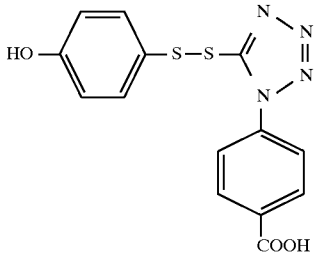
1-12

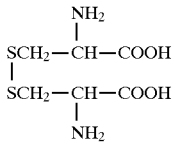
1-13

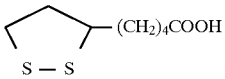
1-14

-continued 1-15

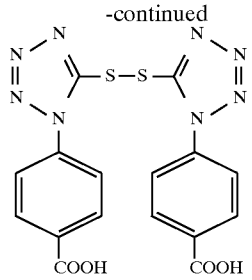

1-16

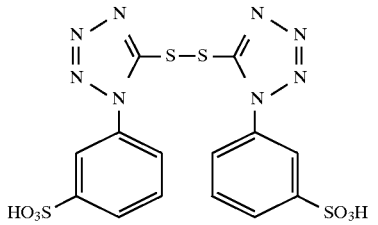

1-17

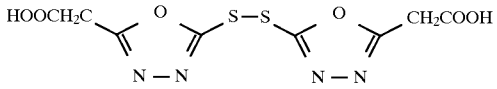

1-18

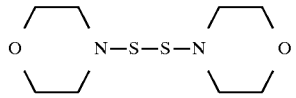

1-19

$nC_4H_9-S-S-nC_4H_9$ 1-20

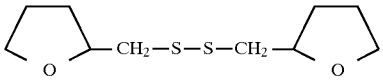

1-21

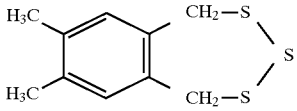

1-22

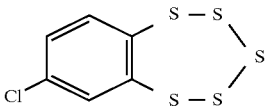

1-23

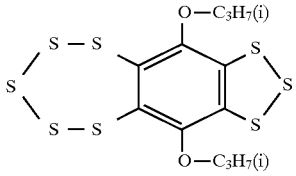

The foregoing compounds can be easily synthesized by the methods described in J. Pharm. Belg. 22 (5–6), 213–19 (1967), U.S. Pat. No. 3,759,932, J. Org. Chem., vol. 23, 64–66 (1967) and J. Med. Chem., vol. 10, No. 6, 1170–1172 (1967).

The compound represented by Formula 1 of the invention is contained preferably in an amount of $1\times10^{-8}$ moles to $5\times10^{-2}$ moles, more preferably $1\times10^{-7}$ moles to $2\times10^{-2}$ moles, per mole of silver halide.

The polysulfide compound can be used in a form of solution in a suitable water-miscible organic solvent such as alcohols, ketones, dimethylsufoxide, dimethylformamide or methyl cellosolve. The compound can be added in a form of dispersion using a known oil. The compound can also be used in a form of particle dispersed in water by a ball mill, colloid mill, impeller dispersing machine or ultrasonic wave dispersing machine according to a method known as solid dispersion method.

In the invention, the compound represented by Formula 1 is contained in the silver halide emulsion layer. Although the compound can be added at any step of the preparation of the silver halide emulsion, it is preferred that the compound is added at a time between the start of chemical sensitization of the silver halide emulsion to just before coating of the emulsion on a support.

The selenium and/or tellurium compound to be used for sensitizing the silver halide emulsion of the invention are described below. The selenium compound usable in the invention includes various kind of selenium compounds.

Suitable selenium compounds includes colloidal metal selenium, isoselenocyanates such as an arylisoselenocyanate, selenoureas such as N,N-dimethylselenourea, N,N,N'-triethyl-selenourea, N,N,N'-trimethyl-N'-heptafluoroselenourea, N,N,N'-trimethyl-N'-heptafluoropropylcarbonylselenourea and N,N,N'-trimethyl-N'-4-nitrophenylcarbonylselenourea, selenoketones such as selenoacetone and selenoacetophenone, selenoamides such as selenoacetoamide and N,N-dimethylselenobenzamide, selenocarbonic acids and selenoesters such as 2-selenopropionic acid and methyl 3-selenobutylate, selenophosphates such as tri-p-tolylselenophosphate, selenides such as triphenylphosphine selenide, diethyl selenide and diethyl diselenide). Particularly preferred selenium sensitizer includes selenides, selenoureas, selenoamides and selenoketones.

The using amount of selenium sensitizer is usually $10^{-8}$ moles to $10^{-4}$ moles per mole of silver halide even though the amount can be changed depending on the kind of selenium compound and silver halide and the condition of chemical sensitization.

The temperature of the chemical sensitization using the selenium sensitizer is preferably within the range of 40° C. to 90° C., more preferably 45° C. to 80° C. The value of pH and pAg of the emulsion are preferably 4 to 9 and 6.0 to 9.5, respectively.

Concrete examples of the selenium sensitizer are listed below.

1

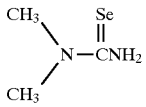

2

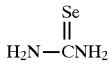

3

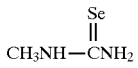

4

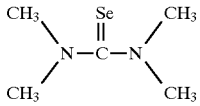

5

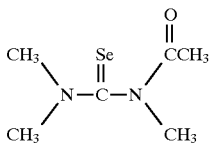

-continued
6
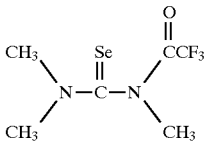
7
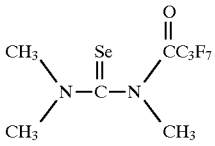
8
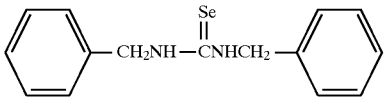
9
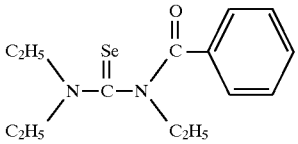
10
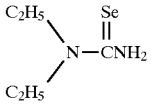
11
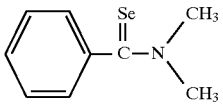
12
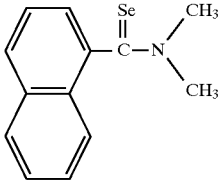
13
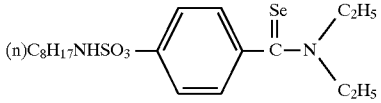
14
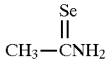
15
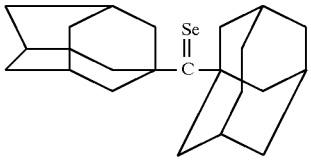
16
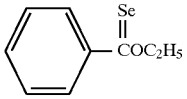
17
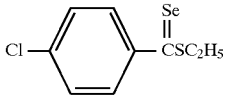
-continued
18
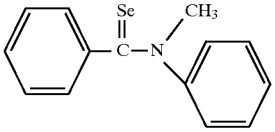
19
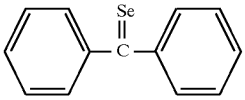
20
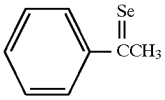
21
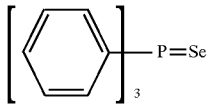
22
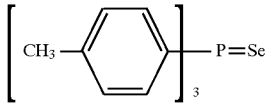
23 $((n)C_4H_9)_3P{=}Se$
24
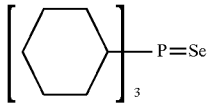
25
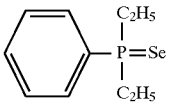
26
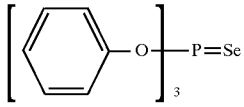
27
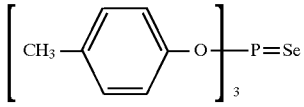
28 $((n)C_4H_9O)_3P{=}Se$
29
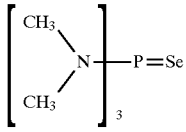
30 $(C_2H_5O)_3P{=}Se$
31
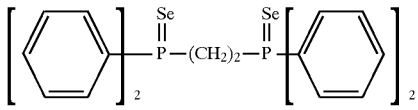
32 $((n)C_8H_{17})_3P{=}Se$
33
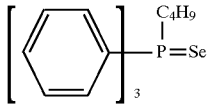

-continued

34

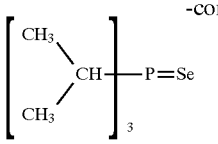

35

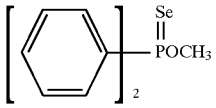

36

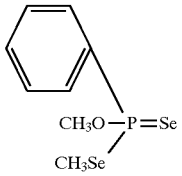

37

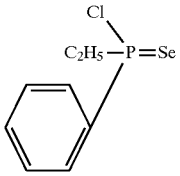

38

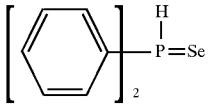

39

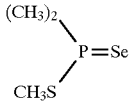

Suitable tellurium sensitizers for the chemical sensitization of the invention include telluroureas such as N-dimethyltellurourea, tetramethyltellurourea, N-carboxyethyl-N,N'-dimethyltellurourea and N,N'-dimethyl-N'-phenyltellurourea, phosphine tellurides such as tributylphosphine telluride, tricyclohexylphosphine telluride, triisopropylphosphine telluride, butyldiiosopropylphosphine telluride and dibutylphenylphosphine telluride, telluroamides such as telluroacetoamide and N,N-dimethyltellurobenzamide, telluro ketones, telluroesters, and isotellurocyanates.

Examples of the tellurium sensitizer are listed below.

$(t\text{-}C_4H_9)_3P{=}Te$ T-1

T-2

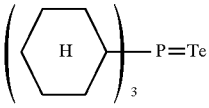

T-3

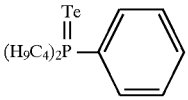

T-4

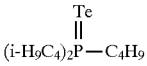

T-5

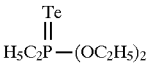

-continued

T-6

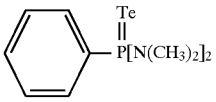

T-7

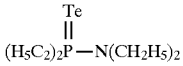

T-8

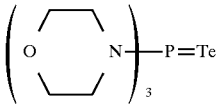

$[(H_3C)_2N]_3P{=}Te$ T-9

T-10

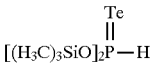

T-11

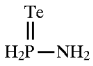

T-12

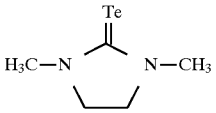

T-13

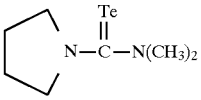

T-14

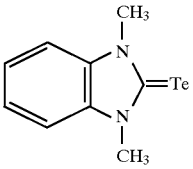

T-15

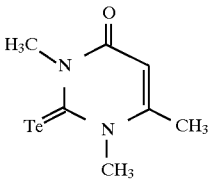

T-16

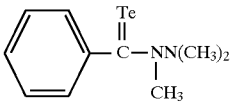

T-17

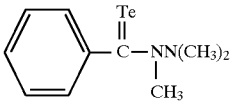

T-18

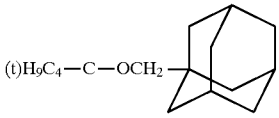

T-19

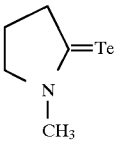

-continued

T-19

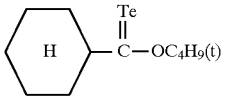

T-20

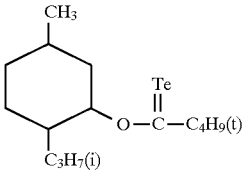

The technique for using the tellurium sensitizer is similar to that for the selenium sensitizer. In the invention, the selenium sensitizer can be used in combination with the tellurium sensitizer for chemical sensitization.

In the invention, it is preferable to use a reduction sensitizer in combination with the foregoing sensitizer. It is preferred to apply the reduction sensitization in the course of growing the silver halide grain. The method for applying the reduction sensitization in the course of grain growing includes not only a method by which the reduction sensitization is applied while the grain is growing but a method by which the grain growing is temporary discontinued and reduction sensitization is applied then the sensitized grain is further grown.

In the invention, sensitization using a sulfur compound and a noble metal salt such as a gold salt can be applied. The chemical sensitization can be carried out by these sensitizing methods with the foregoing selenium sensitizing or tellurium sensitizing method in combination.

Preferable concrete example of the sulfur sensitizer includes thiourea derivatives such as 1,3-diphenylthiourea and triethylthiourea, 1-ethyl-3-(2-thiazolyl)thiourea, rhodanine derivatives, dithiacarbamic acids, organic polysulfide compounds, thiosulfates and elementary sulfur. As the elementary sulfur, α-sulfur having rhombic crystal system.

As the gold sensitizer, gold complexes of various compounds such as thioureas and rhodanines can be used as well as chloroauric acid, gold thiosulfate and gold thiocyanate.

The using amount of sulfur sensitizer and the gold sensitizer are usually $1\times10^{-5}$ moles to $1\times10^{-9}$ moles, preferably $1\times10^{-4}$ moles to $1\times^{-8}$ moles, per mole of silver halide.

The sulfur sensitizer and the gold sensitizer can be added in a form of a solution of water, alcohols or another inorganic or organic solvent or in a form of dispersion in water prepared by using a water-insoluble solvent or a medium such as gelatin. The sulfur sensitization and the gold sensitization can be applied at the same time or separately stepwise. In the later case, preferable result can be obtained often when the gold sensitization is applied after suitable sulfur sensitization or in the course of the sulfur sensitization.

The reduction sensitization is carried out by adding a reducing agent and/or a water soluble silver salt to the silver halide emulsion so that the reduction sensitization is applied while growing the silver halide grains. Preferable example of the reducing agent includes thiourea dioxide and ascorbic acid. Another preferable reducing agent includes a hydrazine, polyamines such as diethylenetriamine, diethylaminoboranes and sulfites.

The tabular particle of silicate compound to be used in the hydrophilic colloid layer of the invention is described below.

In the invention, the "tabular particle of silicate compound" means tabular particle of a silicates having a layer structure and containing an alkali metal, an alkali-earth metal or aluminum, such as kaolin minerals, mica clay minerals or smectites. The kaollin minerals include kaolinite, dickite, nacrite, halloysite and serpentine. The mica clay minerals includes pyrophyllite, talc, white mica, swellable synthetic fluorized mica, cericite and chlorite. The smectites include smectite, vermiculite and swellable synthetic fluorized vermuculite.

Among them, smectites having a swelling ability and ion-exchange ability are preferred. Smectites include a natural smectite and a synthetic smectite. Example of the natural smectite includes montmorillonite and beidellite, which are available as clay so-called bentnite or acid clay. JP O.P.I. Nos. 60-202438 and 60-239747 describe examples of use of the smectite in a non-light-sensitive hydrophilic colloid layer as an antistatic agent.

However, the synthetic smectite is most preferred since which has a high transparency, one containing fluorine for raising the heat resistivity is usable.

As examples of the synthetic smectite, Lucentite SWN (referred to STT-1 in the invention) and Lusentite SWF (referred to STT-2 in the invention) manufactured by Co-op Chemical Co., Ltd. are cited.

The tabular particles of silicate compound are preferably ones in which sum of the projection area of tabular particles having an aspect ratio of not less than 2 accounts for not less than 50% of the total projection area of all silicate particles.

The aspect ratio is defined by the ratio of the diameter of a circle having an area the same as that of a tabular silicate compound particle to the distance between the two parallel face of the tabular particle. In the invention, it is preferred that the aspect ratio is not less than 2 and less than 100, particularly not less than 2 and less than 50.

The thickness of the tabular silicate particle to be used in the invention is preferably not more than 1.0 μm, more preferably not more than 0.5 μm. The distribution of the tabular particles is preferably not more than 30%, more preferably not more than 20% in terms of usual variation coefficient, (S/D)×100, in which S is the standard deviation of circle equivalent diameter of projection area and D is the average circle equivalent diameter.

The hydrophilic colloid layer to which the tabular particle of silicate compound of the invention is added, may be one constituting the silver halide photographic material without any limitation, for example, an silver halide emulsion layer, a protective layer, an interlayer, or a dyed layer, preferably a silver halide emulsion layer and/or a hydrophilic colloid layer provided at a position farther than that of the emulsion layer from the support.

The amount of the tabular particles of silicate compound added to the layer is preferably 0.05 to 1.0. particularly 0.1 to 0.6 in terms of dry weight ratio to binder used in the hydrophilic layer such as gelatin. The tabular silica compound can be used together with colloidal silica.

The tabular particle of silicate compound usable in the invention is usually added to a coating liquid of hydrophilic colloid layer in a form of dispersion in water. The dispersion is preferably prepared in a manner in which the tabular silicate particles are gradually added to a prescribed amount of water while stirring by a high-speed stirrer giving a sufficient shearing force such as a homomixer or a impeller. A dispersing agent, for example, a polyphosphate such as sodium pyrophosphate or sodium hexametaphosphate, a polyhydric alcohol such as trimethylpropane, trimethylolethane or trimethylolmethane, and a nonionic polymer such as polyethylene glycol alkyl ester, may be optionally added for preparing the dispersion.

In the invention, the coating amount of the hydrophilic colloid layer containing the tabular silicate compound particle is preferably 3.0 g/m$^2$, particularly 2.0 to 0.1 g/m$^2$, per one side of the support in terms of the amount of the binder. A hydrophilic colloid substance such as natural or synthetic hydrophilic polymer, for example, gelatin, dextran or polyacrylamide.

Any silver halide composition, for example, silver chloride, silver iodochloride, silver chlorobromide, silver bromide, silver iodobromide or silver chlorobromoiodide, can be optionally used in the silver halide photographic material of the invention. When silver iode is contained, the iodide content is preferably 0 to 1.5 mole-mole, particularly 0 to 1.0 mole-%, in the average value with respect to all silver halide grains contained in the emulsion layer is susable.

The average diameter of silver halide grains used in the invention is preferably 0.15 to 5.0 μm, more preferably 0.2 to 3.0 μm, most preferably 0.2 to 2.0 μm.

Silver halide grains having any crystal habit such as cubic, octahedral and twin can be used, and a tabular grain is preferred.

The tabular silver halide grain is a grain having two parallel surfaces facing each other. The tabular grain usable in the invention may either be one having (111) face or (100) face as the major surface.

The tabular silver halide grain preferably usable in the invention is one having the ratio of the grain diameter to the thickness of the grain, hereinafter, referred to aspect ratio, of not less than 2, preferably not less than 2.0 and less than 15.0, particularly not less than 3 and less than 10. Here, the diameter is a circle equivalent diameter of projection area which is defined by the the diameter of a circle having a area the same as that of the silver halide grain, and the thickness is the distance of two parallel major surfaces constituting the tabular silver halide grain.

When the tabular silver halide grain is used in the invention, the average grain thickness is preferably 0.01 to 1.0 μm, more preferably 0.02 to 0.60 μm, further preferably 0.05 to 0.50 μm. The average grain diameter is preferably 0.15 to 5.0, more preferably 0.4 to 3.0 μm, most preferably 0.4 to 2.0 μm. The tabular silver halide grains preferably have a narrow size distribution, i.e., monodispersed emulsion. The broadness of size distribution defined by the following equation is preferably not more than 25%, more preferably not more than 20%, particularly preferably not more than 15%; (Standard deviation of grain diameter/average grain diameter)×100=broadness of grain size distribution (%)

When the tabular silver halide grain is used in the invention, the tabular grain can be prepared by the method described in U.S. Pat. No. 5,320,938. Namely, it is preferred that a nucleus of the grain is formed under a condition for easily forming (100) face such as the presence of iodide ions with a low pCl. After formation of the nucleus, the nucleus is subjected to Ostwald ripening and/or growing, thus tabular silver halide grains having a desired diameter and size distribution can be obtained.

To the tabular silver halide grain, at least one kind of metal selected from a cadmium salt, a zinc salt, a lead salt, a thallium salt, an iridium salt including an iridium complex salt, rhodium salt including a rhodium complex salt, and an iron salt including an iron complex salt can be added so that the metal ion is contained at the interior and/or the surface thereof.

It is preferable that the tabular silver halide grain to be used in the invention is spectrally sensitized by a sensitizing dye such as a methine dye. The sensitizing dye usable in the invention includes a cyanine dye, a merocyanine dye, a multi-nuclear merocyanine dye, a holopolar cyanine dye, hemicyanine dye, a styryl dye and a hemioxonol dye. Dyes included in the cyanine dye, merocyanine dye or multinuclear merocyanine dye are particularly suitable.

In the dyes, any nucleus usually used are applied. The nucleus includes a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus, and nuclei each formed by condensing an aliphatic carbon hydride ring with the above-mentioned nucleus such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei each may have a substituent on a carbon atom thereof.

To the merocyanine or multi-nuclear merocyanine, a 5- or 6-member heterocyclic nucleus such as a pyrazoline-5-one nucleus, a thiohydantoin nucleus, a 2-thiooxazolidine-2,4-dione nucleus, a thiazoline-2,4-dione nucleus, a thiobarbituric acid nucleus, can be applied as a nucleus having a ketomethine structure.

These sensitizing dyes can be used singly or in combination. The combination of the dyes is frequently used for the purpose of super sensitization. A dye or a compound substantially does not absorb visible light which have no spectral sensitization ability and have a super sensitization ability together with the sensitizing dye can be contained in the silver halide emulsion layer. For example, an aminostilbene compound substituted by a nitrogen-containing heterocyclic group, a condensation product of aromatic organic acid and formaldehyde, a cadmium salt or an azaindene compound may be contained.

It is preferred that the spectral sensitizing dye is added in a form of dispersion of solid fine particle in comparison with that the dye is added in a form of solution of an organic solvent. It is particularly preferred that the dye is added in a form of dispersion of substantially water insoluble solid fine particles in water containing substantially no organic solvent and no surfactant. The diameter of the dispersed particle is preferably not more than 1 μm.

The silver halide photographic light-sensitive material relating to the invention is processed by an automatic processor and the process of developing to drying is completed for a time within the range of 15 seconds to 120 seconds. Namely, a time between the time at which the front of the light-sensitive material is immersed to the developer and the time at which the front of the light-sensitive material is come out from the drying zone of the processor (the time so-called dry to dry) is within the range of from 15 seconds to 120 seconds, preferably 15 seconds to 90 seconds.

The developing time is usually 3 to 40 seconds, preferably 6 to 20 seconds. The developing temperature is usually 25° C. to 50° C., preferably 30° C. to 40° C. The fixing time is usually about 20° C. to 40° C., preferably 29° C. to 37° C., and the fixing time is usually 3 to 30 seconds, preferably 4 to 20 seconds.

The light-sensitive material is dried by blowing air heated usually at a temperature of 35° C. to 100° C., preferably 40° C. to 80° C. A heating means by means of infrared ray may be provided in the drying zone of the processor.

A processor having a means for providing water or an acidic rinsing liquid to the light-sensitive material between the processes of developing and fixing and/or fixing and washing (JP O.P.I. 3-264953) can be used. The processor may have a device for preparing the developing solution or fixing solution built therein.

In the processing method of the invention, the replenishing amounts of the developing solution and fixing solution are each preferably not more than 180 ml/m$^2$, more preferably 8 to 160 ml/m$^2$, particularly preferably 10 to 100 ml/m$^2$, respectively.

In the processing method of the invention, a solidified processing composition is preferably used. For solidifying the processing composition, an optional procedure can be applied, such as a method by which a concentrated solution or a powdered processing composition is kneaded with a water-soluble binder and shaped, or a method by which a water-soluble binder is sprayed on a temporally shaped processing composition, (cf. JP O.P.I. Nos. 4-29136, 4-85535, 4-85536, 4-85533, 4-85534 and 4-172341).

It is preferred method for preparing a tablet that a powdered processing composition is granuled and then tableted. Thus prepared tablet has an advantage that the tablet is improved in a solubilizing ability and a storage ability in comparison with a tablet prepared by simply mixing and tableting the processing composition. Thus the photographic properties of the tableted composition is stabilized.

In the processing method of the invention, although any kind of developing agent usually used can be used, a developing solution containing a reductone compound is preferably usable as a developing agent. As a preservative, a sulfite or an organic reducing agent can be used. Furthermore, a chelating agent or an metabisulfite adduct of hardener can be used. An addition of a silver sludge preventing agent is also preferred. A cyclodextrin compound is also preferably added, and a compound JP O.P.I. No. 1-124853 is particularly preferred. In the developing solution, an amine compound can be added, for example, a compound described in U.S. Pat. No. 4,269,929 is particularly preferred.

In the developing solution to be used in the processing method of the invention, a buffering agent can be used, which includes sodium carbonate, potassium carbonate, sodium bicarbonate, potassium bicarbonate, trisodium phosphate, tripotassium phosphate, dipotassium phosphate, sodium borate, potassium borate, sodium tetrabaorate, potassium tetraborate, sodium o-hydroxybenzoate, potassium o-hydroxybenzoate, 5-sulfo-2-hydroxybenzoate and potassium 5-sulfo-2-hydroxybenzoate.

A thioether compound, a p-phenylenediamine compound, a tertiary ammonium salt, a p-aminophenol, an amine compound, a polyalkylene oxide, a 1-phenyl-3-pyrazolidone, a hydrazine compound, and an imidazole compound can be optionally added as a development accelerator according to necessity.

A halide of an alkali metal such as potassium iodide and an organic fog inhibitor can be used as a fog inhibitor. The organic fog inhibitor includes nitrogen-containing heterocyclic compounds such as benztriazoles, 6-nitrobenzimidazole, 5-nitoindazole, 5-methylbenzotriazole, 5-nitrobenzimidazole, 5-chlorobenzotriazole, 2-thiazolylbenzimidazole, 2-thiazolylmethylbenzimidazole, indazole, hydroxyazaindolidine and adenine. Typical one is 1-phenyl-5-mercaptotetrazole.

In the developing composition to be used in the invention, an organic solvent for raising the solubility of developing agent such as methyl cellosolve, methanol, acetone, dimethylformamide and cyclodextrin can be used according to necessity. Furthermore, various kinds of additive such as a stain preventing agent, a sludge preventing agent and a multilayer effect accelerating agent can be added.

It is preferred to add a starter to the developer before starting the development, and it is also preferred that the starter is added in a form of solidified composition. An organic acid such as a polycarbonic acid compound, a halide of an alkali metal such as potassium bromide, an organic inhibitor and a developing accelerator are usable as the starter.

A known fixing agent usually used can be added to the fixer to be used in the invention as a fixing agent. A fixing agent, a chelating agent, a hardener and a preservant, for example, those described in JP O.P.I. Nos. 4-242246 (page 4), and 5-113632 (pages 2–4) can be added. A known fixing accelerator is also usable.

Various kinds of photographic additive can be used in the emulsion to be used in the silver halide photographic light-sensitive material of the invention in the process of physical ripening, chemical ripening or before or after these processes.

Compounds, for example, described in Research Disclosure (DR) No. 17643 (December 1978), (RD) No. 18716 (November 1979) and (RD) No. 308119 (December 1989) can be used in such the processes. The kinds of compound and described position thereof in the above three (RD) are listed below.

TABLE 1

| | RD-17643 | | RD-18176 | RD-308119 | |
|---|---|---|---|---|---|
| Additive | Page | Class | Page | Page | Class |
| Chemical sensitizer | 23 | III | 648/ur | 996 | III |
| Sensitizing dye | 23 | IV | 648–649 | 996–998 | IVA |
| Desensitizing dye | 23 | IV | | 998 | IVB |
| Dye | 25–26 | VIII | 649–650 | 1003 | VIII |
| Development accelerator | 29 | XXI | 648/ur | | |
| Fog inhibitor, stabilizer | 24 | IV | 649/ur | 1006–1007 | VI |
| Whitening agent | 24 | V | | 998 | V |
| Hardener | 26 | X | 651/l | 1004–1005 | X |
| Surfactant | 26–27 | XI | 650/r | 1005–1006 | XI |
| Antistatic agent | 27 | XII | 650/r | 1006–1007 | XIII |
| Plasticizer | 27 | XII | 650/r | 1006 | XII |
| Lubricant | 27 | XII | | | |
| Matting agent | 28 | XVI | 650/r | 1008–1009 | XVI |
| Binder | 26 | XXII | | 1003–1004 | IX |
| Support | 28 | XVII | | 1009 | XVII |

r: right column
l: left column
ur: upper right column

The supports described in the Research Disclosures are usable in the silver halide photographic light-sensitive material of the invention, and a polyethylene terephthalate film is suitable. The surface of the support may be subjected to provision of a subbing layer of treatment by corona discharge or ultra violet irradiation.

EXAMPLES

Although the invention is described in detail according to examples below, an embodiment of the invention is not limited thereto.

Example 1

(Preparation of seed emulsion EM-T)

| <Solution A> | |
|---|---|
| Ossein gelatin | 37.5 g |
| KI | 0.625 g |
| NaCl | 16.5 g |

-continued

| | |
|---|---|
| Distilled water to make | 7500 ml |
| <Solution B> | |
| Silver nitrate | 1500 g |
| Distilled water to make | 2500 ml |
| <Solution C> | |
| KI | 4 g |
| NaCl | 140 g |
| Distilled water to make | 684 ml |
| <Solution D> | |
| NaCl | 375 g |
| Distilled water to make | 1816 ml |

To Solution A kept at 40° C. in a mixing device described in JP O.P.I. No. 58-58288, 684 ml of Solution B and all of Solution C were added spending 1 minutes. The emulsion was subjected to Ostwald ripening for 20 minutes after adjusting $E_{Ag}$ to 149 mV. Then remainder of Solution A and Solution D are all added spending 40 minutes while controlling $E_{Ag}$ at 149 mV.

The emulsion was desalted and washed just after the completion of the addition of the solutions to obtain a tabular seed emulsion ME-T. It is confirmed by electron microscopic observation that the projection area of tabular silver halide grains each having a (100) face as the major face thereof accounts for 60 % of the whole projection area of silver halide grains in the seed emulsion thus obtained and the average thickness, the average diameter and the variation coefficient of the emulsion grains are 0.07 μm, 0.5 μm and 25%, respectively.

(Preparation of silver chloride rich emulsion EM-1)

A tabular silver chloride rich emulsion EM-1 was prepared using the following four kinds of solution.

| | |
|---|---|
| <Solution A> | |
| Ossein gelatin | 29.4 g |
| $HO(CH_2CH_2)_n(CH[CH_3]CH_2O)_{17}(CH_2CH_2O)_mH$ (n + m = 5–7) | |
| 10% methanol-water solution | 1.25 ml |
| Seed emulsion EM-T | equivalent to 0.98 moles |
| Distilled water to make | 3000 ml |
| <Solution B> | |
| 3.50N $AgNO_3$ aqueous solution | 2240 ml |
| <Solution C> | |
| NaCl | 455 ml |
| Distilled water to make | 2240 ml |
| <Solution D> | |
| 1.75N NaCl aqueous solution | |

To Solution A, Solutions B and C were all added for growing the seed grains by a double-jet method at 40° C. using a mixing device described in JP O.P.I. No. 58-58288 spending 110 minutes so that the flowing rate at the completion of addition was made 3 times of that at the start of addition.

While the addition, $E_{Ag}$ was controlled so as to adjust at +120 mV by using Solution D. The emulsion was subjected to precipitation desalting by the following procedure after the completion of addition for removing excessive salts.

(1) The reacted solution after completion of mixing was adjusted at 40° C. and 20 g/mole of AgX of a gelatin modified by phenylcarbamoyl group (substitution ratio of 90%) was added. Then the pH of the emulsion was lowered to 4.30 by 56 weight % solution of acetic acid. The emulsion was stood and subjected to decantation.

(2) To the precipitate, 1.8 liter/mole of AgX of pure water was added at 40° C. and stirred for 10 minutes. Then the mixture was stood and subjected to decantation.

(3) The above-mentioned procedure was repeated once more.

(4) Then 15 g/mole of AgX of gelatin, sodium carbonate and water were added to the precipitate and the precipitate was dispersed at a pH value of 6.0 and made to a concentration of 450 ml/mole of AgX.

It is confirmed by electron microscopic observation on about 3000 of silver halide grains that the projection area of tabular grains having (100) face as the major surface thereof accounts for not less than 80% of whole projection area of the grains contained in the emulsion and the tabular grains had an average diameter of 1.17 μm, an average diameter of 0.12 μm and variation coefficient of 24%.

(Chemical sensitization of the emulsion)

To thus obtained silver chloride rich emulsion EM-1 heated by 55° C., $2\times10^6$ moles per mole of silver halide of a compound of Formula 1 of the invention was added as described in Table 2. Then a prescribed amount of silver iodide fine grain, and dispersion of solid particles of spectral sensitizing dyes 1 and 2 were added. The emulsion was ripened for 90 minutes in total after addition of a sulfur sensitizer, a selenium sensitizer and a gold sensitizer. 4-hydroxy-6-methyl-1,3,3a,7-tetraazaindene (TAI) was added at the completion of the ripening as a stabilizer.

| | |
|---|---|
| Silver iodide fine grains* | equivalent to 5 milimole |
| Spectral sensitizing dye 1 | 300 mg |
| Spectral sensitizing dye 2 | 30 mg |
| Sulfur sensitizer | 2.0 mg |
| Gold sensitizer | 1.0 mg |
| Selenium sensitizer (Triphenylphosphine selenide) | 1.0 mg |
| Stabilizer (TAI) | 50 mg |

*The silver iodide fine grains were prepared by adding 2 liters of a solution containing 7.06 moles of silver nitrate and a 2 liters of a solution containing 7.06 moles of potassium iodide to 6.64 liters of a 5 weight % gelatin aqueous solution containing 0.06 moles of potassium iodide spending 10 minutes. During the grain formation, the pH was controlled at 2.0 by using nitric acid and the temperature was kept at 40° C. After grain formation, the pH value was adjusted to 6.0 by a sodium carbonate solution.

Spectral sensitizing dye 1

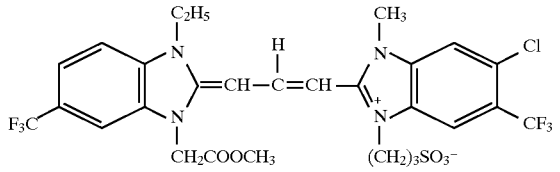

Spectral sensitizing dye 2

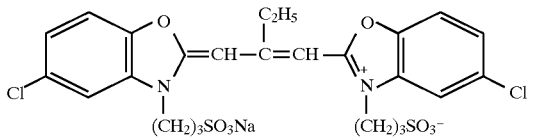

-continued

Sulfur sensitizer

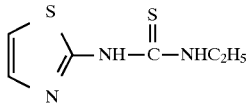

Gold sensitizer

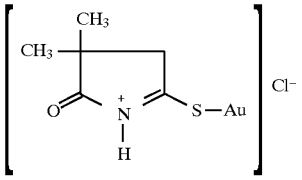

The solid particle dispersion of the spectral sensitizing dye was prepared according to the method described in JP O.P.I. No. 5-297496. Namely, a prescribed amount of the spectral sensitizing dye was added to water previously adjusted at 27° C. and stirred for 30 to 120 minutes with a speed of 3,500 rpm by a high-speed stirrer (dissolver) to form a dispersion.

The dispersion of the above-mentioned selenium sensitizer was prepared by the following procedure. To 30 kg of ethyl acetate adjusted at 50° C., 120 g of triphenylphosphine selenide was added and completely dissolved by stirring. On the other hand, a solution was prepared by dissolving 3.8 kg of photographic gelatin in 38 kg of purified water and adding 93 g of a 25 weight-% aqueous solution of sodium dodecylbenzenesulfonate. The above two solutions were mixed and dispersed at 50° C. for 30 minutes by a high-speed stirring dispersing machine having a dissolver of 10 cm diameter with a circumferential speed of stirrer wing of 40 m/second. Then ethyl acetate was rapidly removed under a reduced pressure so that the remaining amount of ethyl acetate become 0.3 weight-% or less. After removing ethyl acetate, the dispersion was diluted by purified water to make to 80 kg. A part of thus obtained dispersion was used for the test.

(Preparation of coating liquid and coating)

Samples Nos. 1 to 35 were each prepared by simultaneously coating and drying the following emulsion layer and protective layer on both side of a support in this order. The support was a blue tinted polyethylene terephthalate film of 175 μm having a density of 0.15 and the following crossover cutting layer were previously provided on the both sides thereof.

First layer (Crossover cutting layer)

| | |
|---|---|
| Solid fine particle dispersion of dye (AH) | 180 mg/m$^2$ |
| Gelatin | 0.2 g/m$^2$ |
| Sodium dodecylbenzenesulfonate | 5 mg/m$^2$ |
| Compound (I) | 5 mg/m$^2$ |
| Sodium salt of 2,4-dichloro-6-hydroxy-1,3,5-triazine | 5 mg/m$^2$ |
| Colloidal silica (Average diameter of 0.014 μm) | 10 mg/m$^2$ |

Second layer (Silver halide emulsion layer)

The following additives were added to the foregoing silver halide emulsion.

| | |
|---|---|
| Compound (G) | 0.5 mg/m$^2$ |
| 2,6-bis(hydroxyamino)-4-diethylamino-1,3,5-triazine | 5 mg/m$^2$ |
| t-butylchatecol | 130 mg/m$^2$ |

-continued

| | |
|---|---|
| Polyvinylpyrrolidone (Molecular weight of 10,000) | 35 mg/m$^2$ |
| Styrene-maleic anhydride copolymer | 80 mg/m2 |
| Sodium polystyrenesulfonate | 80 mg/m$^2$ |
| Trimethylolpropane | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Compound (P) | 20 mg/m$^2$ |
| Compound (Q) | 20 mg/m$^2$ |
| Tabular silicate compound particle or latex for comparison | Described in Table 2 |

The amount of gelatin was adjusted so that the coating amount was 0.8 g/m$^2$.

Third layer (Protective layer)

| | |
|---|---|
| Gelatin | 0.6 g/m$^2$ |
| Matting agent of polymethyl methacrylate (Area average circle equivalent diameter of 7.0 μm) | 50 mg/m$^2$ |
| Formaldehyde | 20 mg/m$^2$ |
| Sodium salt of 2,4-dichloro-6-hydroxy-1,3,5-triazine | 10 mg/m$^2$ |
| Bis-vinylsulfonylmethyl ether | 36 mg/m$^2$ |
| Polyacrylamide (Average molecular weight of 10000) | 0.1 g/m$^2$ |
| Sodium polyacrylate | 30 mg/m$^2$ |
| Polysiloxane (S1) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}O(CH_2CH_2O)_{11}H$ | 3 mg/m$^2$ |
| $C_8F_{17}SO_2N—(C_3H_7)(CH_2CH_2O)_{15}H$ | 2 mg/m$^2$ |
| $C_8F_{17}SO_2N—(C_3H_7)_4(CH_2CH_2O)(CH_2)_4SO_3Na$ | 1 mg/m$^2$ |
| Hardener (B) | 60 mg/m$^2$ |
| Tabular silicate compound particle or latex for comparison | Described in table 2 |

As the tabular silicate compound, Lucentite SWN (STT-1) and Lucentite SWF (STT-2). SST-2 is a silicate compound containing 2 to 5% by weight of sluorine atom. The thickness and the aspect ratio of particles of SST-1 and SST-2 are as follows:

| | Thickness | Aspect ratio |
|---|---|---|
| SST-1 | 0.011 μm | 45 |
| SST-2 | 0.010 μm | 47 |

Compound (G)

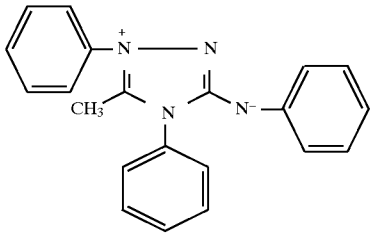

-continued

Compound (H)

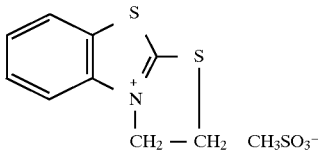

Compound (I)

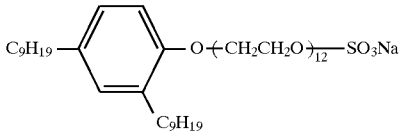

Compound (J)

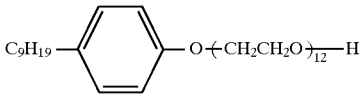

Compound (K)

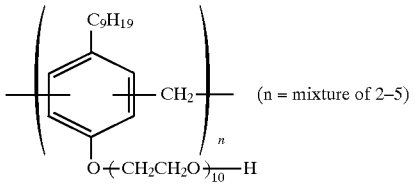

Compound (S-1)

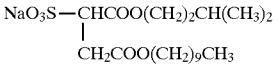

Compound (S-2)

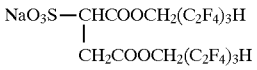

Polysiloxane (S1)

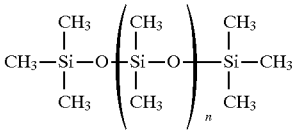

Dispersion of fine solid particle of dye (AH)

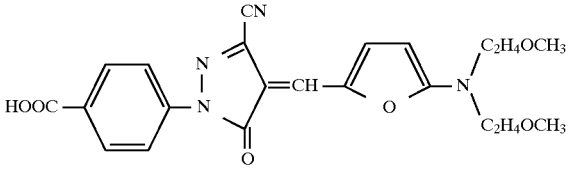

Compound (O)

$C_{11}H_{23}CONH(CH_2CH_2O)_5H$

-continued

Compound (M)

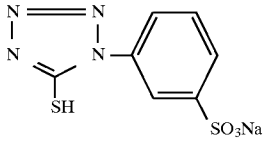

Compound (N)

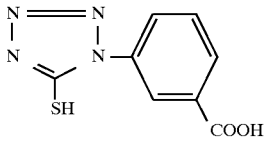

Hardener (B)

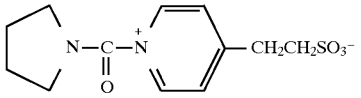

Compound (P)

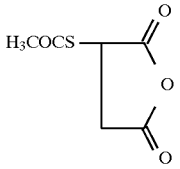

Compound (Q)

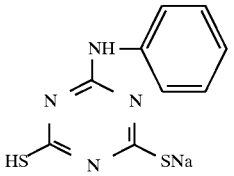

Latex for comparison

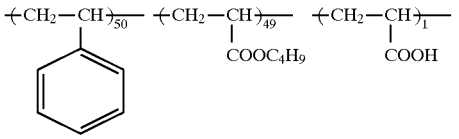

The foregoing coating amounts are each the amount coated per one side of the sample. The coating amount of silver of the emulsion layer was adjusted so that the coating amount of silver was 1.3 g/m$^2$ per side of the sample.

(Preparation of processing composition)

A developer replenisher table and a fixer replenisher tablet were prepared by the following Procedure (A to D).

Procedure (A)

In a bandom mill available on the market, 13000 g of sodium erythorbate was powdered so that the average diameter was become 10 $\mu$m. To the fine powder, 4877 g of sodium sulfite, 975 g of phenidone and 1635 g of diethylenetriaminepentaacetate (DTPA) were added and mixed for 30 minutes in the mill. The mixture was granulated with 30 ml of water by a stirring granulation machine for 10 minutes at a room temperature. The granules were dried for 2 hours at 40° C. by a fluidized-bed dryer to completely remove moisture. To thus obtained granules, 2167 g of D-mannitol was added and uniformly mixed for 10 minutes by a mixer installed in a room conditioned at 25° C. and a relative humidity of 40%. The mixture was tableted by a tableting machine of modified Toughpress Correct 1527HU, manufactured by Kikusui Seisakusyo Co., Ltd. The charging amount of the mixture was 8.715 g per tablet. Thus 2500 of developer replenisher tablets A were prepared.

Procedure (B)

In a manner similar to that in Procedure (A), 19500 g of potassium carbonate, 8.15 g of 1-phenyl-5-mercaptotetrazole, 3.25 g of sodium hydrogen carbonate, 650 g of sulfite adduct of glutaraldehyde and 1354 g of polyethylene glycol #6000 were powdered and granulated. The adding amount of water was 30.0 ml. After granulation, the granules were dried for 30 minutes at 50° C. to completely remove moisture in the granules. Thus obtained mixture was tableted by the tableting machine in a rate of 9.90 g per tablet. Thus 2500 of developer replenisher tablets B were prepared.

Procedure (C)

In a manner similar to that in Procedure (A), 18560 g of ammonium thiosulfate, 1392 g of sodium sulfite, 580 g of sodium hydroxide, and 2.32 g of disodium ethylenediamine-tetraacetate were powdered and granulated. The adding amount of water was 500 ml. After granulation, the granules were dried for 30 minutes at 60° C. to completely remove moisture in the granules. Thus obtained mixture was tableted by the tableting machine in a rate of 8.214 g per tablet. Thus 2500 of fixer replenisher tablets C were prepared.

Procedure (D)

In a manner similar to that in Procedure (A), 1860 g of boric acid, 6500 g of aluminum sulfate 18 hydrate, 1860 g of glacial acetic acid, and 925 g of sulfuric acid (50 weight-%) were powdered and granulated. The adding amount of water was 100 ml. After granulation, the granules were dried for 30 minutes at 50° C. to completely remove moisture in the granules. Thus obtained mixture was tableted by the tableting machine in a rate of 4.459 g per tablet. Thus 2500 of fixer replenisher tablets D were prepared.

An initial developing solution was prepared by adding 330 ml of starter to 16.5 liter of developer having a pH value of 10.7 which was prepared by diluting thus prepared developer replenisher tablets by diluting water.

| <Composition of developer> | |
|---|---|
| Potassium carbonate | 120.0 g/l |
| Sodium erythorbate | 40.0 g/l |
| DTPA | 5.0 g/l |
| 1-phenyl-5-mercaptotetrazole | 0.05 g/l |
| Sodium hydrogen carbonate | 20.0 g/l |
| Phenidone | 3.0 g/l |
| Sodium sulfite | 15.0 g/l |
| D-mannitol | 15.0 g/l |
| Sulfite adduct of glutaraldehyde | 4.0 g/l |
| <Developer starter> | |
| Glacial acetic acid | 210 g |
| KBr | 530 g |
| Water to make | 1 l |

An initial fixing solution having the following composition was prepared by diluting the fixer replenisher tablets by diluting water.

| Composition of initial fixing solution | |
|---|---|
| Ammonium thiosulfate | 160.0 g/l |
| Sodium sulfite | 12.0 g/l |
| Boric acid | 1.0 g/l |
| Sodium hydroxide | 5.0 g/l |
| Glacial acetic acid | 10.0 g/l |

-continued

| Composition of initial fixing solution | |
|---|---|
| Aluminum sulfate 18 hydrate | 35.0 g/l |
| Sulfuric acid (50 weight-%) | 5.0 g/l |
| Disodium ethylenediamine-tetraacetate dihydrate | 0.02 g/l |

Evaluation (Evaluation of sensitivity)

A sample of film was put between two sheets of intensifying screen KO-250, manufacture by Konica Corp., and irradiated by X-ray through Penetrometer, manufactured by Konica Medical Co., Ltd. Then the sample was processed by an automatic processor SRX-502, manufacture by Konica Corp., which was modified so that the processing time was as follows and a device for supplying a solidified processing composition was attached on it. The processing was carried out using the processing solutions and the developing temperature was set at 35° C.

The sensitivity was expressed by a relative value of a reciprocal of amount of X-ray necessary to form a density of the minimum density+1.0 to that of Sample No. 1 which was set as 100.

| Processing condition | | |
|---|---|---|
| Development | 35° C. | 6.6 seconds |
| Fixing | 33° C. | 4.0 seconds |
| Washing | Room temperature | 3.6 seconds |
| Squeezing | | 1.3 seconds |
| Drying | 40° C. | 4.5 seconds |
| | Total | 20.0 seconds |

(Evaluation of tone of silver image)

The sample was exposed to X-ray so as to obtain a density of 1.2±0.5 and processed in the same manner as the above, and the tone of the formed image was visually evaluated and classified according to the following ranks.

A: Pure black

B: Slightly yellowish black

C: Yellowish black (Evaluation of roller marks)

A sample was exposed to X-ray so as to obtain a density of 1.2±0.5 and processed in the same manner as the above except that the developing rack and the transporting rack between the developing tank and the fixing tank were replaced by ones intentionally fatigued. Irregularities about 10 $\mu$m were formed on the surface of each of the rollers of the racks. Fine spot-shaped density unevenness caused by pressure by the surface irregularities are formed on a sample having a low pressure resistivity. The level of formation of the spots was evaluated and classified according to the following ranks.

A: No spot was formed.

B: a little number of spots were formed.

C: many spots were formed.

(Evaluation of unevenness of glossiness)

A sample was exposed to X-ray so as to obtain a density of 1.2±0.5 and processed in the same manner as the above. The glossiness was evaluated and classified according to the following ranks.

A: Slight unevenness of glossiness was formed, but no problem on the visual observation.

B: Unevenness of glossiness was formed, but acceptable for visual observation.

C: Considerable unevenness of glossiness was formed and not suitable for visual observation.

Thus obtained results are shown in Table 2.

TABLE 2

| Sample No. | Compound of Formula (1) | Tabular silicate particle Exemplified No. | Adding amount | Added layer | Sensitivity | Roller mark (Pressure fogging) | Silver image tone | Unevenness of glossiness | Note |
|---|---|---|---|---|---|---|---|---|---|
| 1 | none | STT-1 | 0.3 | Em. | 100 | B | C | B | Comp. |
| 2 | none | STT-1 | 0.6 | Em. | 102 | B | C | B | Comp. |
| 3 | none | STT-1 | 0.2 | Pro. | 100 | B | C | B | Comp. |
| 4 | none | STT-1 | 0.4 | Pro. | 104 | B | C | B | Comp. |
| 5 | none | STT-2 | 0.3 | Em. | 99 | B | C | B | Comp. |
| 6 | none | STT-2 | 0.1 | Pro. | 100 | B | C | B | Comp. |
| 7 | 1-5 | — | — | — | 115 | C | C | A | Comp. |
| 8 | 1-5 | Latex | 0.3 | Em. | 110 | B | C | C | Comp. |
| 9 | 1-5 | Latex | 0.2 | Pro. | 113 | B | C | C | Comp. |
| 10 | 1-5 | STT-1 | 0.3 | Em. | 115 | A | A | B-A | Inv. |
| 11 | 1-5 | STT-1 | 0.6 | Em. | 117 | A | A | B-A | Inv. |
| 12 | 1-5 | STT-1 | 0.2 | Pro. | 121 | A | A | A | Inv. |
| 13 | 1-5 | STT-1 | 0.4 | Pro. | 117 | A | A | A | Inv. |
| 14 | 1-5 | STT-2 | 0.3 | Em. | 113 | A | A | B-A | Inv. |
| 15 | 1-5 | STT-2 | 0.6 | Em. | 111 | A | A | B-A | Inv. |
| 16 | 1-5 | STT-2 | 0.2 | Pro. | 125 | A | A | A | Inv. |
| 17 | 1-5 | STT-2 | 0.4 | Pro. | 120 | A | A | A | Inv. |
| 18 | 1-15 | — | — | — | 118 | C | C | A | Comp. |
| 19 | 1-15 | Latex | 0.3 | Em. | 110 | B | C | C | Comp. |
| 20 | 1-15 | Latex | 0.2 | Pro. | 116 | B | C | C | Comp. |
| 21 | 1-15 | STT-1 | 0.3 | Em. | 118 | A | A | B-A | Inv. |
| 22 | 1-15 | STT-1 | 0.6 | Em. | 115 | A | A | B-A | Inv. |
| 23 | 1-15 | STT-1 | 0.2 | Pro. | 121 | A | A | A | Inv. |
| 24 | 1-15 | STT-1 | 0.4 | Pro. | 120 | A | A | A | Inv. |
| 25 | 1-15 | STT-2 | 0.3 | Em. | 117 | A | A | B-A | Inv. |
| 26 | 1-15 | STT-2 | 0.6 | Em. | 115 | A | A | B-A | Inv. |
| 27 | 1-15 | STT-2 | 0.2 | Pro. | 123 | A | A | A | Inv. |
| 28 | 1-15 | STT-2 | 0.4 | Pro. | 120 | A | A | A | Inv. |
| 29 | 1-22 | — | — | — | 115 | C | C | A | Comp. |
| 30 | 1-22 | Latex | 0.3 | Em. | 111 | B | C | C | Comp. |
| 31 | 1-22 | Latex | 0.2 | Pro. | 114 | B | C | C | Comp. |
| 32 | 1-22 | STT-1 | 0.3 | Em. | 113 | A | A | B-A | Inv. |
| 33 | 1-22 | STT-1 | 0.2 | Pro. | 116 | A | A | A | Inv. |
| 34 | 1-22 | STT-2 | 0.3 | Em. | 115 | A | A | B-A | Inv. |
| 35 | 1-22 | STT-2 | 0.2 | Pro. | 116 | A | A | A | Inv. |

Adding amount: weight ratio to gelatin

As is shown in Table 2, no roller mark and no unevenness of glossiness are formed on the samples according to the invention and the samples of the invention give a pure black silver image and a high-sensitivity.

Example 2

Samples 36 through 70 were prepared in the same manner as in Sample 1 through 35, respectively except that 0.9 mg per mole of silver of the following tellurium sensitizer was used in place of the sulfur sensitizer.

Tellurium sensitizer

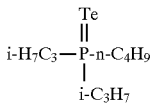

The samples were evaluated in the same manner as in Example 1. Thus obtained results are listed in Table 3.

TABLE 3

| Sample No. | Compound of Formula (1) | Tabular silicate particle Exemplified No. | Adding amount | Added layer | Sensitivity | Roller mark (Pressure fogging) | Silver image tone | Unevenness of glossiness | Note |
|---|---|---|---|---|---|---|---|---|---|
| 36 | none | SST-1 | 0.3 | Em. | 100 | B | C | B | Comp. |
| 37 | none | SST-1 | 0.6 | Em. | 100 | B | C | B | Comp. |
| 38 | none | SST-1 | 0.2 | Pro. | 102 | B | C | B | Comp. |
| 39 | none | SST-1 | 0.4 | Pro. | 102 | B | C | B | Comp. |
| 40 | none | SST-2 | 0.3 | Em. | 98 | B | C | B | Comp. |
| 41 | none | SST-2 | 0.1 | Pro. | 103 | B | C | B | Comp. |
| 42 | 1-5 | — | — | — | 121 | C | C | A | Comp. |
| 43 | 1-5 | Latex | 0.3 | Em. | 113 | B | C | C | Comp. |

TABLE 3-continued

| Sample No. | Compound of Formula (1) | Tabular silicate particle Exemplified No. | Adding amount | Added layer | Sensitivity | Roller mark (Pressure fogging) | Silver image tone | Unevenness of glossiness | Note |
|---|---|---|---|---|---|---|---|---|---|
| 44 | 1-5 | Latex | 0.2 | Pro. | 116 | B | C | C | Comp. |
| 45 | 1-5 | STT-1 | 0.3 | Em. | 120 | A | A | B-A | Inv. |
| 46 | 1-5 | STT-1 | 0.6 | Em. | 118 | A | A | B-A | Inv. |
| 47 | 1-5 | STT-1 | 0.2 | Pro. | 123 | A | A | A | Inv. |
| 48 | 1-5 | STT-1 | 0.4 | Pro. | 121 | A | A | A | Inv. |
| 49 | 1-5 | STT-2 | 0.3 | Em. | 118 | A | A | B-A | Inv. |
| 50 | 1-5 | STT-2 | 0.6 | Em. | 115 | A | A | B-A | Inv. |
| 51 | 1-5 | STT-2 | 0.2 | Pro. | 124 | A | A | A | Inv. |
| 52 | 1-5 | STT-2 | 0.4 | Pro. | 122 | A | A | A | Inv. |
| 53 | 1-15 | — | — | — | 117 | C | C | A | Comp. |
| 54 | 1-15 | Latex | 0.3 | Em. | 115 | B | C | C | Comp. |
| 55 | 1-15 | Latex | 0.2 | Pro. | 117 | B | C | C | Comp. |
| 56 | 1-15 | SST-1 | 0.3 | Em. | 115 | A | A | B-A | Inv. |
| 57 | 1-15 | SST-1 | 0.6 | Em. | 114 | A | A | B-A | Inv. |
| 58 | 1-15 | SST-1 | 0.2 | Pro. | 118 | A | A | A | Inv. |
| 59 | 1-15 | SST-1 | 0.4 | Pro. | 117 | A | A | A | Inv. |
| 60 | 1-15 | SST-2 | 0.3 | Em. | 113 | A | A | B-A | Inv. |
| 61 | 1-15 | SST-2 | 0.6 | Em. | 111 | A | A | B-A | Inv. |
| 62 | 1-15 | SST-2 | 0.2 | Pro. | 119 | A | A | A | Inv. |
| 63 | 1-15 | SST-2 | 0.4 | Pro. | 117 | A | A | A | Inv. |
| 64 | 1-22 | — | — | — | 120 | C | C | A | Comp. |
| 65 | 1-22 | Latex | 0.3 | Em. | 115 | B | C | C | Comp. |
| 66 | 1-22 | Latex | 0.2 | Pro. | 118 | B | C | C | Comp. |
| 67 | 1-22 | STT-1 | 0.3 | Em. | 119 | A | A | B-A | Inv. |
| 68 | 1-22 | STT-1 | 0.2 | Pro. | 121 | A | A | A | Inv. |
| 69 | 1-22 | STT-2 | 0.3 | Em. | 116 | A | A | B-A | Inv. |
| 70 | 1-22 | STT-2 | 0.2 | Pro. | 118 | A | A | A | Inv. |

It is understood that, in the samples according to the invention, the roller marks and the unevenness in the glossiness are inhibited and a pure black silver image and a high sensitivity can be obtained.

As is established in the examples, a silver halide photographic light-sensitive material and a processing method therefor are obtained by the invention, which has a high sensitivity and gives a pure black tone silver image, in which formation of the roller marks and the unevenness of glossiness are inhibited.

What is claimed is:

1. A silver halide photographic light-sensitive material comprising a support having thereon a silver halide emulsion layer and optionally a hydrophilic colloid layer, in which said silver halide emulsion layer comprises silver halide grains sensitized by a selenium compound or a tellurium compound, and a polysulfide compound, and at least one of said silver halide emulsion layer and the hydrophilic colloid layer contains a tabular particle of a silicate compound.

2. The light-sensitive material of claim 1, wherein said polysulfide compound is a compound represented by Formula 1;

$$R_1—(S)_n—R_2 \qquad \text{Formula 1}$$

wherein $R_1$ and $R_2$ are each independently an aliphatic group, an aromatic group or a heterocyclic group, the groups represented by $R_1$ and $R_2$ which may be bonded with each other to form a ring, and n is an integer of 2 to 6.

3. The light-sensitive material of claim 1, wherein said silica compound is a silicate having a layer structure.

4. The light-sensitive material of claim 3, wherein said silicate having a layer structure is selected from the group consisting of kaolin minerals, mica minerals or smectites.

5. The light-sensitive material of claim 4, wherein said silicate is selected from the smectites.

6. The light-sensitive material of claim 1, wherein said tabular particle of silicate compound has an aspect ratio of not less than 2 and less than 100.

7. The light-sensitive material of claim 1, wherein said layer containing said tabular particle of silicate compound is said silver halide emulsion layer or a hydrophilic colloid layer provided at a position farther from said silver halide emulsion layer with respect to said support.

* * * * *